US006371845B1

(12) United States Patent
Ishida et al.

(10) Patent No.: US 6,371,845 B1
(45) Date of Patent: Apr. 16, 2002

(54) COIN PROCESSING METHOD AND APPARATUS

(75) Inventors: Takeshi Ishida, Sakado; Jun Yamada, Kawagoe, both of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/403,186

(22) PCT Filed: Feb. 12, 1999

(86) PCT No.: PCT/JP99/00630

§ 371 Date: Oct. 18, 1999

§ 102(e) Date: Oct. 18, 1999

(87) PCT Pub. No.: WO99/42958

PCT Pub. Date: Aug. 26, 1999

(30) Foreign Application Priority Data

Feb. 18, 1998 (JP) ..... 10-036037

(51) Int. Cl.[7] ..... G07D 1/00; G07D 9/00

(52) U.S. Cl. ..... 453/17; 453/63; 194/200; 194/217; 194/350

(58) Field of Search ..... 453/17, 53; 194/200, 194/217, 350

(56) References Cited

U.S. PATENT DOCUMENTS 3,982,620 A * 9/1976 Kortenhaus ..... 194/217 X
4,374,529 A * 2/1983 Kobayashi et al. ..... 453/17
4,883,158 A * 11/1989 Kobayashi et al. ..... 453/17 X
5,092,816 A * 3/1992 Levasseur ..... 453/17
5,380,242 A * 1/1995 Matsumoto et al. ..... 453/17 X
5,499,944 A * 3/1996 Weston et al. ..... 453/17
5,885,151 A * 3/1999 Weston et al. ..... 453/17
5,954,576 A * 9/1999 Coulter et al. ..... 453/17
5,997,396 A * 12/1999 Itako ..... 453/17

FOREIGN PATENT DOCUMENTS

JP 01-305496 A 12/1989
JP 02-012393 A 1/1990
JP 02-266488 A 10/1990
JP 07-272046 A 10/1995

* cited by examiner

*Primary Examiner*—Dean J. Kramer
*Assistant Examiner*—Thuy V. Tran
(74) *Attorney, Agent, or Firm*—Hogan & Hartson, L.L.P.

(57) ABSTRACT

The number of coins stored in a coin tube is retained in RAM 13 which is backed up by a battery, the states of empty switch 22 and full coin switch 23 and the type of cassette tube to be detected by cassette detection sensor 21 are retained in the battery-backup RAM 13, and when the power supply is intercepted and turned on again, the states of the empty switch 22 and the full coin switch 23 and the type of cassette tube detected by the cassette detection sensor 21 which are stored in the battery-backup RAM 13 are compared with their current states, and if any of them does not agree, the number of coins retained in the RAM 13 is initialized.

13 Claims, 5 Drawing Sheets

COIN PROCESSING METHOD AND APPARATUS

TECHNICAL FIELD

The present invention relates to a method and an apparatus for money processing such as receiving, sorting, paying-out and the like of money, and more particularly to a money processing method and apparatus which can store and hold the number of stored money to be used as change in a battery-backup memory and initialize the number of stored money retained in the memory with an appropriate timing.

BACKGROUND ART

A money processor used in automatic vending machines, money-changing machines, etc receives money inserted and pays-out change if necessary. Money to be paid-out as change are chiefly coins which are stored in coin tubes for respective types of coins. A cassette-type coin tube is also available, which is detachable from the money processor so that it is easy to supply coins and to change the capacity for holding each type of coin (see Japanese Patent Application laid-Open No. 60-55486).

A sensor (hereinafter, it is called the empty switch) is attached to the coin tube at a given height from its bottom to detect the presence or not of coins, and it is judged from the detected result by the empty switch whether change can be paid-out or not. For example, when thirteen (13) coins or more are stored in the coin tube, the empty switch is set at the position where these coins can be detected. If the empty switch had a detection error of three coins or less, it detects that 13±3 coins or more are stored in the coin tube. Therefore, when the empty switch detects that coins are stored in the coin tube, it means that at least ten coins are stored in the coin tube.

However, if it is judged whether change can be paid-out based only on the detected result by the empty switch, when the coins stored in the coin tube are decreased to nine coins or less, it is judged that the pertinent type of money can not be paid-out, hence even though the change can actually be paid-out, a commodity that requires change is stopped from being sold, resulting in loosing an opportunity of selling. Therefore, a counter is provided in addition to the empty switch to count the number of received coins or paid-out coins, and based on the counted result, it is judged whether change can be paid-out or not.

FIG. 5 is a flowchart showing a process of counting the number of stored coins by the counter.

The counter starts its operation when the power of the money processor is turned on (step 601). At this time, if the number of coins stored in the coin tube is nine or less, that is, if the empty switch detects a state of no coin (NO in step 602), since it is unknown how many coins are stored in the coin tube, the counter keeps its value as zero. When the empty switch indicates the presence of coins or indicates that no coins state is changed to the presence of coins by receiving coins (YES in step 602), since at least ten coins are stored in the coin tube, the value of the counter is preset to ten (step 603).

Here, when a sensor (hereinafter, it is called the full coin switch), which is located at a predetermined position at an upper part the coin tube, for detecting whether the coin tube is full, has detected that the coin tube is full (YES in step 604), the counter value is preset to hundred (100) (when the full coin switch detects that the coin tube is full, the coin tube shall contain at least 100 coins) (step 605).

Next, when the pertinent type of coin is inserted and stored into the coin tube (YES in step 606), one is added to the value of the counter (step 607). And when a coin is paid-out from the coin tube (YES in step 608), one is subtracted from the value of the counter (step 609).

When the counter value changes from ten to nine as a result of the increase and decrease of the coins in the coin tube (YES in step 610) and the empty switch indicates the presence of coins (YES in step 611), the counter indicates that nine coins are in the coin tube while the empty switch indicates that at least ten coins are stored in the coin tube. Therefore, the value of the counter is preset to ten (step 603).

Moreover, when the coins in the coin tube are increased and decreased and the empty switch indicates a change from a state showing the presence of coins to a state showing no coin (YES in step 612), it shows that the number of coins stored in the coin tube has become 12±3. Then, the value of the counter is preset to nine (step 613). When the empty switch indicates a change from a state showing no coin to a state showing the presence of coins (YES in step 614), it shows that the number of coins stored in the coin tube has become 13±3. Then, the value of the counter is preset to ten (step 615).

When the counter value is changed as described above, the counter value does not necessarily correspond to the number of coins stored in the coin tube. For example, when the power supply is turned on with eighty coins stored in the coin tube, the counter value is ten, and with five coins stored in the coin tube, the counter value becomes 0. Therefore, the former case is judged that change cannot be paid-out though it can actually be paid (for example, where one 500-yen coin is inserted to buy a 350-yen commodity and a 100-yen coin tube has no 100-yen coin, a 50-yen coin tube has no 50-yen coin and a 10-yen coins can be paid-out as change.

However, it is judged that no change can be paid-out when the value of the counter which corresponds to the 10-yen coin tube is ten. And, in the latter case, even if change can be actually paid-out (for example, five coins are stored), it is judged that the pertinent type of money can not be paid-out.

However, when the empty switch and the full coin switch indicate a change with the increase and decrease of coins after turning on the power (YES in steps 604, 612, 614), the counter value is preset to a value which substantially corresponds to the number of coins stored in the coin tube. After that, judgement on a possibility of paying-out change based on the counter value is made accurately.

Therefore, frequency of resetting the counter value is desirably few, but since the counter value is reset when the power is interrupted, turned on again or fails (including an instantaneous power failure) or the voltage changes, a battery-backup RAM is used to retain the counter value to prevent such resetting.

However, when the counter value is retained in the battery-backup RAM, the counter value can be kept even when the power is cut off for maintenance of the automatic vending machine, the money processor, etc. and the coins are collected from the coin tube or the tube cassettes are exchanged at the same time Therefore, the counter value might be larger than the number of coins actually stored in the coin tube. In this case, judgment of the change pay-out is not made correctly, possibly resulting in a failure of not paying change.

SUMMARY OF THE INVENTION

In view of the circumstances described above, it is an object of the present invention to provide an method and an apparatus for processing money which can retain a value obtained by counting the number of coins stored in a coin tube in a battery-backup RAM and does not initialize the retained counter value more than necessary but initializes it with appropriate timing.

To achieve the object described above, the invention is characterized by a method of money processing in which inserted money is stored in a storage means and money is paid-out from the money stored in the storage means, wherein the number of money stored in the storage means is counted based on the number of money stored in the storage means and the number of money paid-out from the storage means, the counted number of money and the states of respective parts are held in memory means which can hold information irrelevant of the power on or off, and the number of money held in the memory means is initialized if the state when the power supply is turned on is different from the state held in the memory means.

The invention is also characterized by the method described above, wherein the money stored in the storage means are coins; and the number of coins being stored in the storage means is counted based on the number of coins stored in the storage means and the number of coins paid-out from the storage means, the counted number of coins and the states of respective parts are held in the memory means which can hold information irrelevant of the power on or off, and the number of coins retained in the memory means is initialized if the state when the power supply is turned on is different from the state retained in the memory means.

The invention is also characterized in that when an empty switch for detecting that the number of coins stored in the storage means becomes a predetermined number or below has different detection output before the power cut-off and after the power on, the number of money retained in the memory means is initialized.

The invention is further characterized in that when a full switch for detecting that the storage means for holding the coins is full has different detection output before the power cut-off and after the power on, the number of money retained in the memory means is initialized.

The invention is also characterized by the storage means is detachable from a money processing apparatus and provided in a plurality of number of types; and when a type of storage means before the power cut-off is different from a type of storage means at the power on, the number of coins retained in the memory means is initialized.

The invention also provides that predetermined data is held in the memory means; and when the predetermined data retained in the memory means is different from the original data at the power on, the number of coins retained in the memory means is initialized.

The invention is characterized by a money processing apparatus including storage means for storing inserted money and pay-out means for paying-out the money from the storage means, wherein the apparatus comprises counting means for counting the number of money being stored in the storage means based on the number of money stored in the storage means and the number of money paid-out from the storage means by the pay-out means; memory means for retaining the number of money counted by the counting means and the states of respective parts regardless of the power on or off; and initializing means for initializing the number of money retained in the memory means when the state at the power on is different from the state retained in the memory means.

The invention is characterized by the money stored in the storage means are coins; and the storage means has at least one coin number detecting means for detecting the number of coins stored in the storage means.

The invention is also characterized by the coin number detecting means is an empty switch which detects that the number of coins stored in the storage means becomes a predetermined number or below; the memory means, when detection output of the empty switch varied, stores the output state; and the initializing means initializes the number of coins retained in the memory means when the state of the empty switch before the interception of the power supply retained in the memory means is different from the state of the empty switch when the power supply is turned on.

The invention is also characterized by the coin number detecting means is a full switch for detecting that coins are full in the storage means; the memory means stores an output state each time a detection output of the full switch varies; and the initializing means initializes the number of coins retained in the memory means when the state of the full switch before the interception of the power supply retained in the memory means is different from the state of the full switch when the power supply is turned on.

The invention is characterized by the storage means is detachable from the money processing apparatus and provided in a plurality of number of types; the memory means retains the types of storage means; and when a type of storage means before the interception of the power supply retained in the memory means is different from a type of storage means at the power on, the initializing means initializes the number of coins retained in the memory means.

The invention is further characterized by a data storage means for storing predetermined data, wherein the memory means retains the predetermined data which is stored in the data storage means; and when the predetermined data retained in the memory means before the power on is different from the data stored in the data storage means, the initializing means initializes the number of coins retained in the memory means.

BRIEF DESCRIPTION OF THE DRAWINGS

FIG. 4 is a flowchart showing a process of an initial operation of the money processing apparatus 1 when the power supply is turned on.

DETAILED DESCRIPTION OF THE INVENTION

An embodiment of a method and apparatus for processing money according to the invention will be described in detail with reference to the accompanying drawings.

Figure 1:
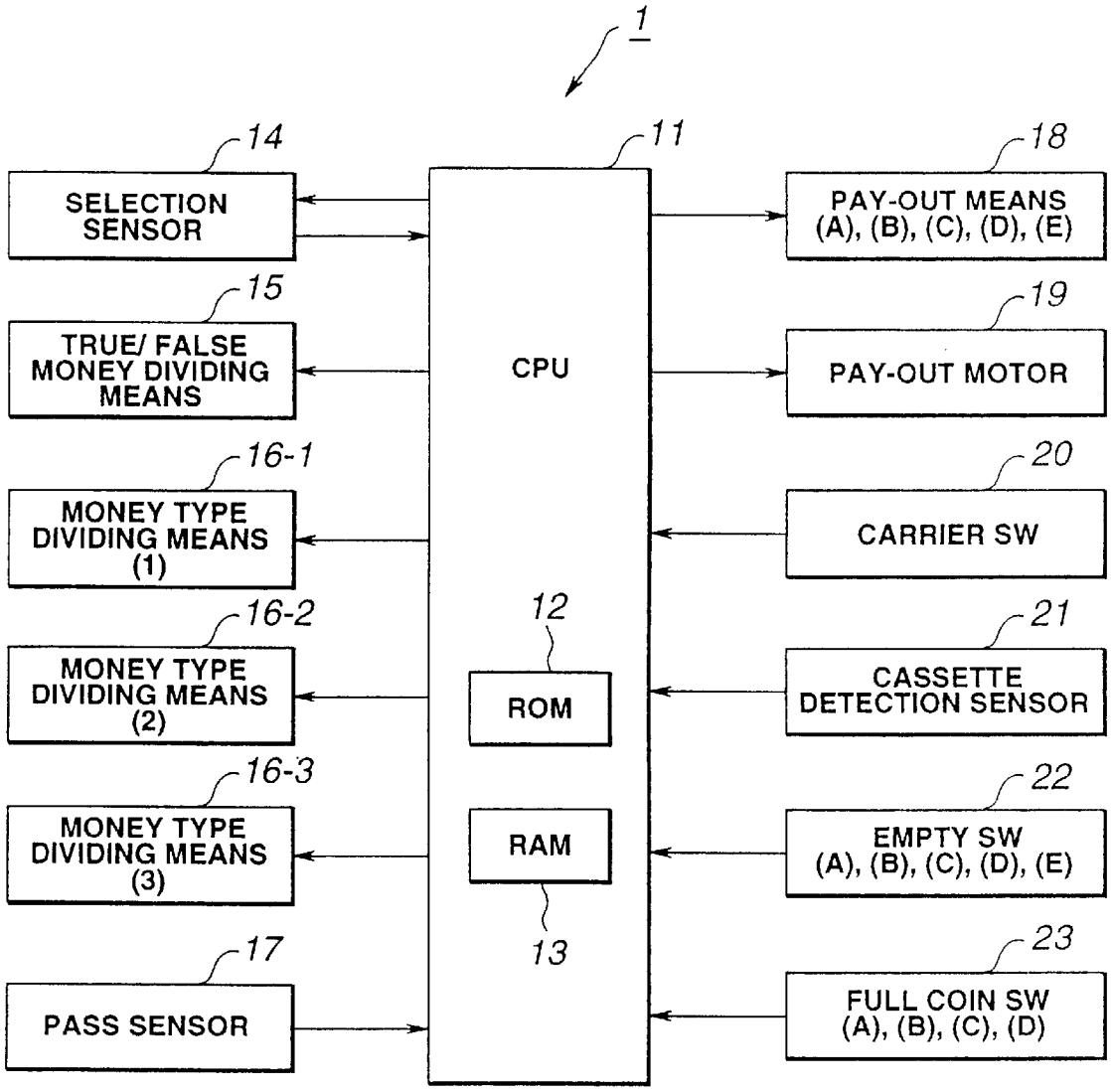
FIG. 1 is a block diagram showing a configuration of a money processing apparatus.

FIG. 1 is a block diagram showing a configuration of the money processing apparatus.

A money processing apparatus 1 comprises CPU 11 for controlling each component and for necessary calculations, ROM 12 and RAM 13 which are memory means mounted on the CPU 11, a selection sensor 14 for judging a type of money, a true/false money dividing means 15 to divide the inserted coin into a tube or counterfeit money based on the output from the selection sensor 14, money type dividing means 16 (16-1 through 16-3) to further divide the coin, which was divided as true money by the true/false money dividing means 15 based on the output from the selection sensor 14, according to the money type, a pass sensor 17 to detect that the inserted coin has passed through a predetermined position of a coin passage (not shown), pay-out means 18 to pay-out a coin or coins from a cassette tube (not shown), a pay-out motor 19 to transport the coin or coins paid-out by the pay-out means 18 to a pay-out port, a carrier switch (SW) 20 to detect that the pay-out motor 19 is operating properly, a cassette detection sensor 21 to detect detachment or attachment of a cassette tube (not shown) and its type, an empty switch (SW) 22 to detect that the coins in the cassette tube have decreased to a predetermined number, and a full coin switch (SW) 23 to detect that the cassette tube is full with the coins.

Now, the flow of a coin in the money processing apparatus 1 will be described with reference to the FIG. 2.

Figure 2:
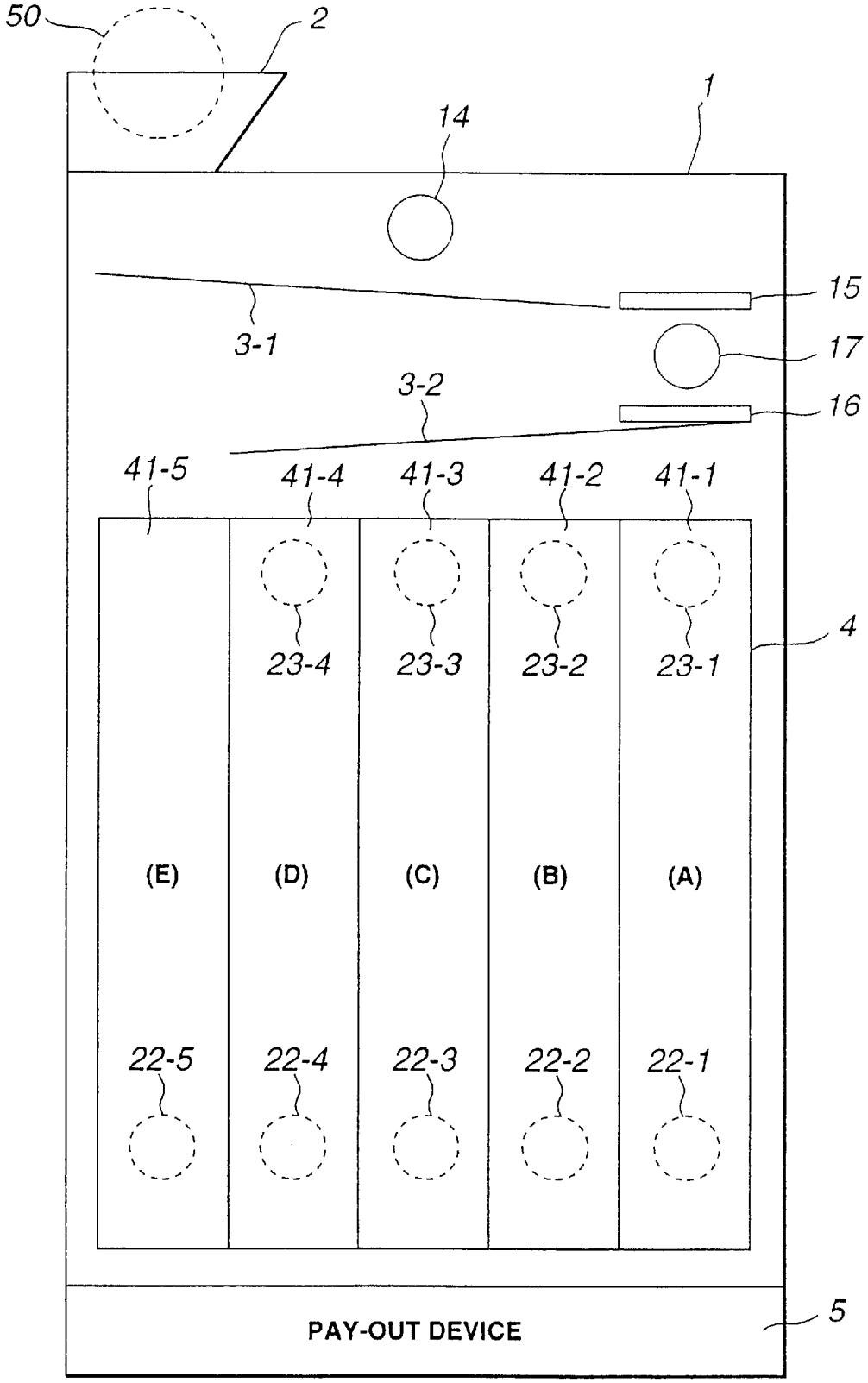
FIG. 2 is a diagram schematically showing the money processing apparatus 1.

FIG. 2 is a diagram schematically showing the money processing apparatus 1.

In the money processing apparatus 1, a coin 50 inserted through an insertion port 2 is moved through a coin passage 3-1 by gravitation and subjected to true/false money dividing and money type selection by the selection sensor 14 on the way. The coin 50 which passed through the selection sensor 14 is divided into a true or counterfeit coin by the true/false money dividing means 15 according to the selection result by the selection sensor 14. And, the true coin is sent to the money type dividing means 16 and the counterfeit coin is returned to a return port (not shown).

When the coin 50 is divided as the true coin by the true/false money dividing means 15, it is sent to the money type dividing means 16 and detected by the pass sensor 17 on its way to the money type dividing means 16. The money type dividing means 16 divides the coin 50 according to its type and guides it to one, which corresponds to the money type of the coin 50, of coin tubes (A) 41-1 to (D) 41-1 of the cassette tube 4 through a coin passage 3-2. But, when a full coin switch 23 (one of 23-1 to 23-4) of the corresponding coin tube shows that the pertinent coin tube is full, the coin 50 is lead to a safe (not shown).

The money type dividing means 16 comprises money type dividing means (1) 16-1, money type dividing means (2) 16-2, and money type dividing means (3) 16-3 as shown in FIG. 1. The money type dividing means (1) 16-1 sorts the coin 50 into the cassette tube 4 or a safe (not shown). The money type dividing means (2) 16-2 sorts the coin 50, which was sorted into the side of the cassette tube 4 by the money type dividing means (1) 16-1, into one of the side the coin tubes (A) 41-1 and (B) 41-2 or the sides of the coin tubes (C) 41-3 and (D) 41-4. The money type dividing means (3) 16-3 sorts the coin 50, which was sorted into the side of the coin tubes (A) 41-1 and (B) 41-2 by the money type dividing means (2) 16-2, into the coin tube (A) 41-1 and the coin tube (B) 41-2 and the coin 50, which was sorted into the side of the coin tubes (C) 41-3 and (D) 41-4, into the coin tubes (C) 41-3 and (D) 41-4.

The coin 50, which was led into the cassette tube 4, is paid-out by a pay-out device 5, which comprises the pay-out means 18, the pay-out motor 19, the carrier switch 20, etc. (see FIG. 1), when change is paid-out.

The coin tubes (A) 41-1 to (E) 41-5 configuring the cassette tube 4 are provided with empty switches 22-1 to 22-5 respectively. The coin tube (E) 41-5 is not provided with the full coin switch 23 because it only pays-out the coins previously stored therein and does not receive any coin.

The coin tube (E) 41-5 may be configured so as to receive the inserted coins, in which case, the coin tube (E) 41-5 is provided with the full coin switch 23.

Figure 3:
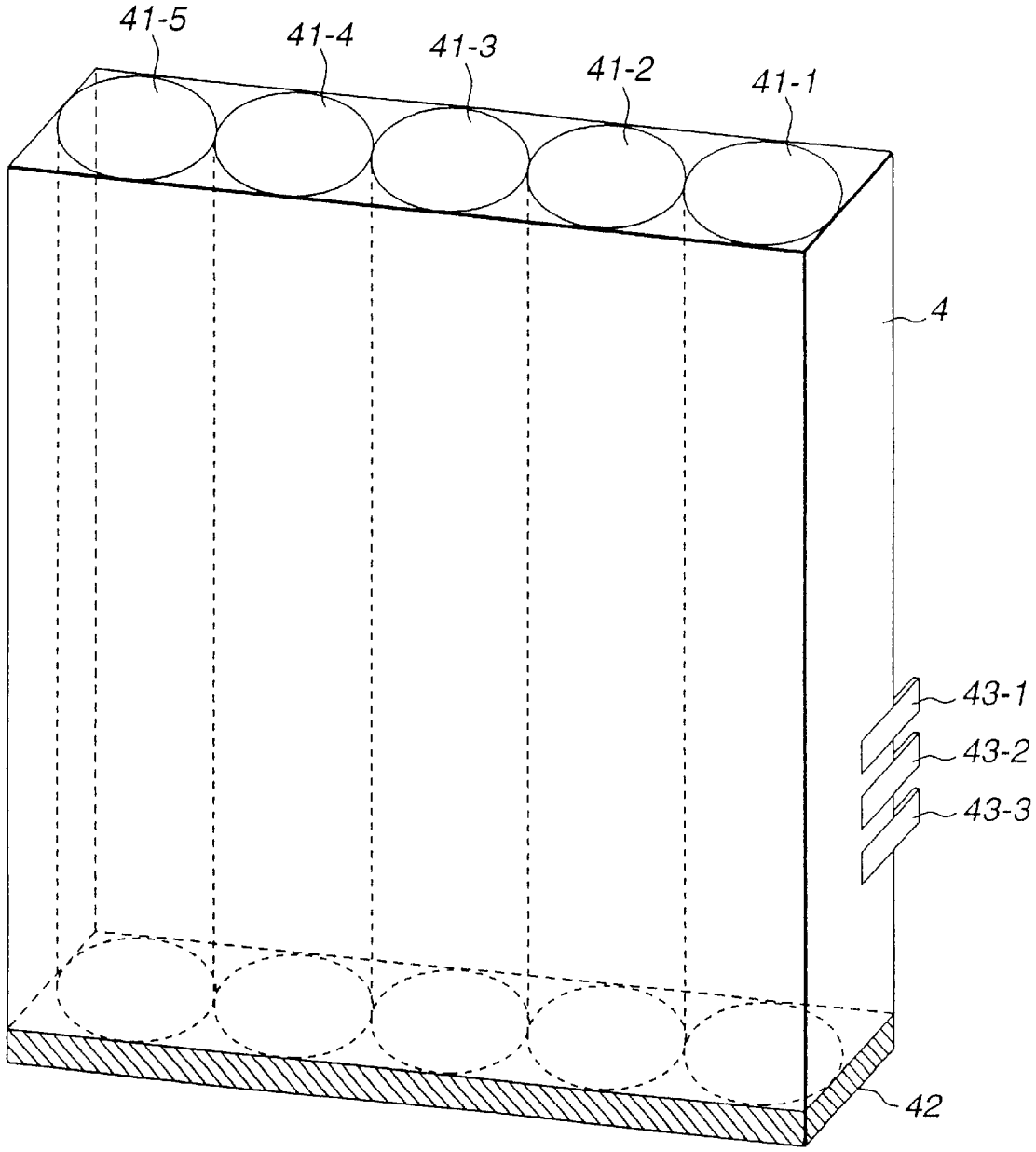
FIG. 3 is a diagram schematically showing a cassette tube 4.

FIG. 3 is a diagram schematically showing the cassette tube 4.

It shows that the cassette tube 4 is a cassette consisting of the five coin tubes 41-1 to 41-5 as a set and has a pay-out slide plate 42 at its bottom in order to receive the coins stored in the coin tubes 41-1 to 41-5 and to be removed from the cassette tube 4 when the cassette tube 4 is mounted on the money processing apparatus 1 so to let the stored coins be sent into the pay-out device 5.

Moreover, the cassette tube 4 has a plurality of types depending on a type of coin to be stored and a capacity (for example, all the coin tubes 41-1 to 41-5 store different types of coins or the same type of coin), and projections 43-1 to 43-3 are provided in order to indicate a type of cassette. The projections 43-1 to 43-3 indicate the type of cassette tube 4 by their presence or not, and can distinguish three bits by the three projections, namely maximum of eight types. When the cassette tube 4 is mounted on the money processor 1, its presence is detected by the cassette detection sensor 21 of the money processing apparatus 1, and its type is judged by the money processing apparatus 1. In the money processing apparatus 1, the CPU 11 counts the number of coins stored in the respective coin tubes 41-1 to 41-5 based on the states of the empty switch 22 and the full coin switch 23, the number of inserted coins (obtained from the operating state of the money type dividing means 16 and the output of the pass sensor 17) and the number of paid-out coins (obtained from the operating state of the pay-out means 18) in the same manner as the money processor described in the background of the invention and stores the counted number in RAM 13. The RAM 13 is backed up by a battery so that its stored contents are not lost even if the power of the coin processing apparatus 1 was cut off.

To prevent a failure from occurring due to a large difference between the number of coins retained in the RAM 13 when the power is turned on and the number of coins actually stored in the coin tubes 41-1 to 41-5, the number of coins retains in the RAM 13 is initialized if any of the following four conditions applies.

A first condition is that when the power supply is turned on, the state of the empty switch 22 (22-1 to 22-5) (output of detection of the presence or not of the coin) is different from the state of the empty switch 22 immediately before the interception of the power supply retained in the RAM 13. A second condition is that when the power supply is turned on, the state of the full coin switch 23 (23-1 to 23-4) (output of detection whether the coins are full) is different from the state of the full coin switch 23 immediately before the interception of the power supply retained in the RAM 13.

Moreover, a third condition is that when the power supply is turned on, the type of cassette tube 4 detected by the cassette detection sensor 21 is different from the type of cassette tube 4 immediately before the interception of the power supply retained in the RAM 13. And, a fourth condition is that dummy data stored in the RAM 13 when the RAM 13 was initialized last time is different from dummy data retained in the ROM 12.

Among these conditions, in the first and second conditions, the coin tubes 41-1 to 41-5 configuring the cassette tube 4 are compared for their states immediately before the power supply is intercepted and after the power supply is turned on (re-turning on of the power). If any one of the coin tubes 41-1 to 41-5 had a change, it is clear that the coins stored in the pertinent coin tube were collected or replenished. But the RAM 13 is initialized assuming that the coins stored in the other four coin tubes were also collected or replenished, and the number of stored coins are newly counted according to the state of the empty switch 22.

Moreover,it is clear that the number of stored coins and the money types are changed because the type of cassette tube 4 is changed in the third condition. And the RAM 13 is initialized and the number of stored coins is newly counted according to the state of the empty switch 22.

The fourth condition is a condition to check the reliability of the contents held in the RAM 13 which is backed up by the battery. If the dummy data retained in the RAM 13 is different from the dummy data which must be originally the same data and stored in the ROM 12, the state immediately before the interception of the power supply retained in the RAM 13 before comparing the number of coins stored in the cassette tube 4 is not reliable. Therefore, the RAM 13 is initialized to newly count the number of stored coins based on the state of the empty switch 22.

When the RAM 13 is initialized, the dummy data memorized in the ROM 12 is newly stored in the RAM 13 for the next power switch-on.

Figure 4:
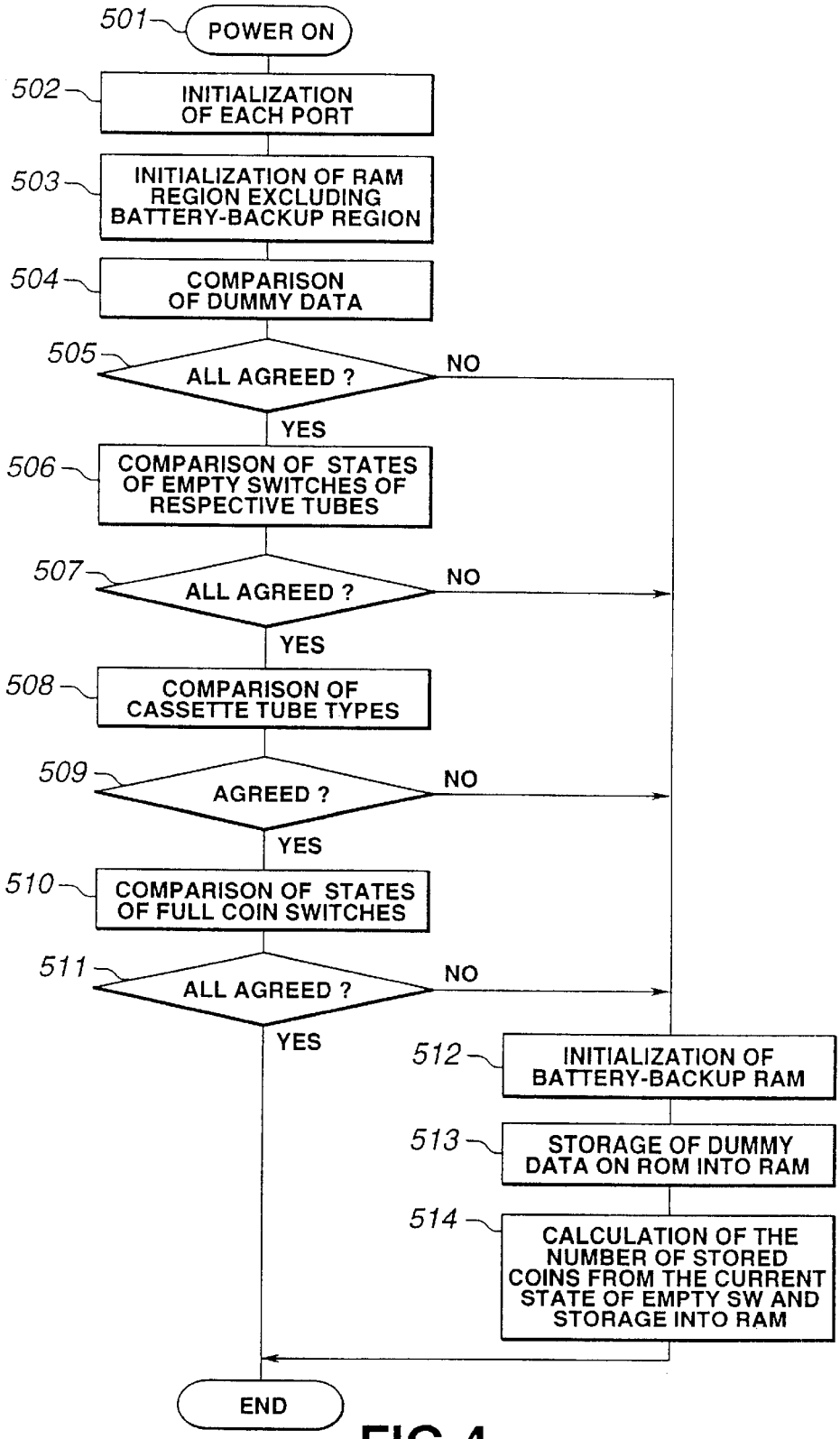
Figure 5:
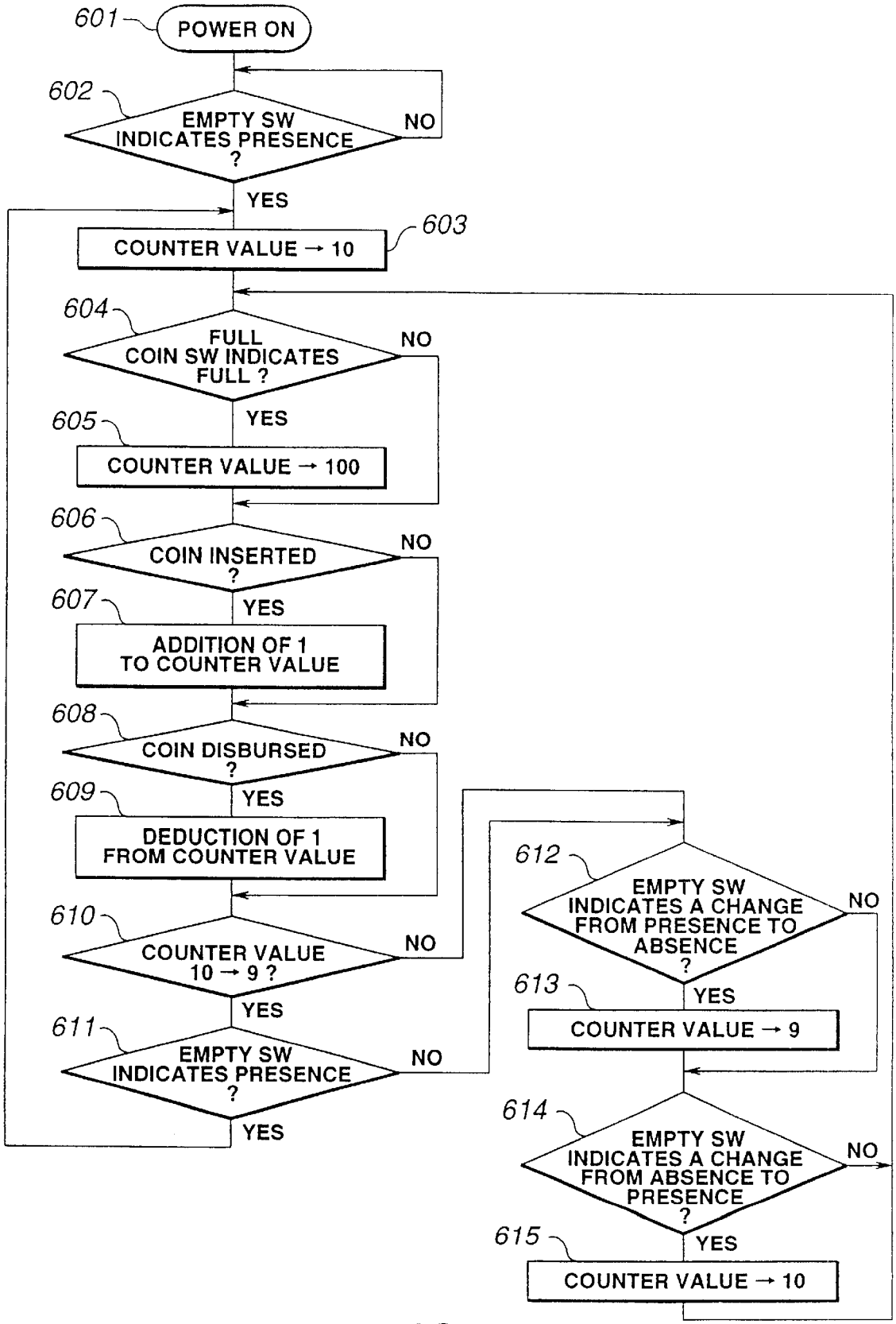
FIG.5 PRIOR ART
FIG. 5 is a flowchart showing a process of counting the number of stored coins by a counter.

Here, the flow of an initial operation of the money processing apparatus 1 when the power supply is turned on will be described with reference to FIG. 4. FIG. 4 is a flowchart showing the flow of the initial operation of the money processing apparatus 1 when the power supply is turned on. The money processing apparatus 1 begins to make the initial operation when the power supply is turned on (step 501). First, each port for communicating with the control of an automatic vending machine to which the money processing apparatus 1 is connected is initialized (step 502). And a part of the RAM 13 which is not backed up by the battery is initialized (step 503).

Then, the dummy data which is retained in the battery-backup part in the RAM 13 is compared with the dummy data retained in the ROM 12 (step 504). As a result of this completely (YES in step 505), the states of the empty switches 22-1 to 22-5 of the coin tubes 41-1 to 41-5 of the cassette tube 4 are compared with the states of the empty switches 22-1 to 22-5 immediately before the interception of the power supply stored in the RAM 13 (step 506). Here, if all the states of the empty switches 22-1 to 22-5 at present correspond to the states before the power supply is intercepted (YES in step 507), the type of cassette tube 4 detected by the cassette detection sensor 21 is compared with the type of cassette tube 4 immediately before the power supply interception retained in the RAM 13 (step 508). As a result of the comparison, when the cassette tubes 4 have the same type (YES in step 509), the respective states of the full coin switches 23-1 to 23-4 are compared with the states of the full coin switches 23-1 to 23-4 immediately before the power supply interception retained in the RAM 13 (step 510), As a result, when all the states of the full coin switches 23-1 to 23-4 correspond to one another (YES in step 511), it indicates that all the results of the comparison of the dummy data (step 504), the comparison of the states of the empty switches 22 (step 506), the comparison of the types of cassette tubes 4 (step 508) and the comparison of the states of the full coin switches 23 (step 510) are the same to the states immediately before the power supply is intercepted. Therefore, it is judged that the coins stored in the cassette tube 4 were not collected or replenished while the power supply is intercepted, and the initial operation is terminated (step 515), and the operation shifts to a usual operation (sales standby operation).

On the other hand, when any of the comparison of the dummy data (step 504), the comparison of the states of the empty switches (step 506), the comparison of the types of cassette tubes 4 (step 508) or the comparison of the full coin switches 23 (step 510) results in disagreement (NO in any of step 505, 507, 509 or 511), it is judged that the contents retained in the RAM 13 is not reliable or the coins stored in the cassette tube 4 were collected or replenished, and a region (or all regions) of the RAM 13 backed up by the battery is initialized (step 512), the dummy data retained in the ROM 12 is stored in the RAM 13 (step 513), the number of coins stored in the cassette tube 4 are calculated from the current state of the empty switch 22 and stored in the RAM 13 (step 514), the initial operation is terminated (step 515), and the operation is shifted to a usual operation (sales standby operation).

When the states of the empty switch 22 and the full coin switch 23 and the type of cassette tube 4 detected by the cassette detection sensor 21 are changed while the coin processing apparatus 1 is operating normally, the contents retained in the RAM 13 are renewed, so that if the power supply is intercepted, the state immediately before the interception is always retained. When the coins stored in the cassette tube 4 are collected or replenished with the power on while the money processing apparatus 1 is operating normally, the RAM 13 is initialized when the cassette detection sensor 21 detects the removal of the cassette tube 4.

The embodiment was described on the money processing apparatus which pays-out coins. The invention can also be applied to a money processing apparatus for paying-out paper money which is used for a money-changing machine, and automatic vending machine for selling high-priced commodity and the like, so that a state incapable of paying-out money which results from the collection or replenishment of paper money during the interception of the power supply can be prevented.

The invention relates to a method and apparatus for money processing by which the number of coins stored in the coin tube is held in battery-backup RAM, the states of the empty switch and the full coin switch and the type of cassette tube to be detected by the cassette detection sensor are stored in the battery-backup RAM, and when the power is intercepted and turned on again, the states of the empty switch and the full coin switch and the type of cassette tube to be detected by the cassette detection sensor which are retained in the RAM are compared with their current states, and if any of them does not agree, the number of coins retained in the RAM is initialized. By configuring as described above, the retained number of coins is not lost even if the power is intercepted due to a power failure, it is properly judged whether the coins stored in the cassette tube can be paid-out or not, and it is possible to prevent a problem of incapable of paying-out coins which may be caused due to a difference between the actual number of coins and the number of coins retained in the RAM owing to the collection or replenishment of coins during the interception of the power supply.

What is claimed is:

1. An apparatus for money processing in which inserted money is stored in a storage means and money is paid-out from the money stored in the storage means, comprising:

detection means for detecting whether or not the amount of money stored in the storage means is not more than a predetermined number;

counting means for counting an amount of money based on the amount of money stored in the storage means and an amount of money paid-out from the storage means;

a memory means for storing and holding a value of the amount of money counted by the counting means and the detected output of the detection means, said memory means storing and holding information even if the power is cut off;

wherein the value of the amount of money stored and held in the memory means is initialized if the detected output detected by the detection means at the time the power is turned on is different from the detected output of the detection means before the power was turned on; and wherein the counting means counts the amount of money stored in the storage means based on the initialized value of the amount of money.

2. The apparatus according to claim 1, wherein:

the storage means is a coin tube which stores coins;

the detection means is a switching means which is disposed at a predetermined position of the coin tube and which detects whether or not a number of coins stored in the coin tube is not more than the predetermined number corresponding to the disposed position of the coin tube; and a value of the number of coins stored and held in the memory means is initialized based on the predetermined number.

3. The apparatus according to claim 2, wherein the switch means is an empty switch which is disposed at a lower part of the coin tube and which detects whether or not the number of coins stored in the coin tube is not more than the predetermined value.

4. The apparatus according to claim 2, wherein the switch means is a full switch which is disposed at an upper part of the coin tube and which detects that the coin tube is full with coins.

5. The apparatus according to claim 2, wherein the memory means stores and holds a type of coin tube and initializes at the time the power is turned on, the value of number of coins stored and held in the memory means if the type of coin tube is different from the type of coin tube stored and held in the memory means.

6. The apparatus according to claim 2, wherein the memory means stores and holds predetermined data and initializes the value of number of coins stored and held in the memory means at the time the power is turned on if the predetermined data stored it the memory means is different from previously stored predetermined data.

7. A money processing method including a storage means for storing inserted money and pay-out means for paying-out the money stored in the storage means, wherein said method comprises:

detecting an output of whether or not the amount of money stored in the storage means is less than a predetermined number;

storing and holding a value of amount of money stored and the detected output in a memory means;

counting the amount of money being stored in the storage means based on the amount of money stored in the storage means and the amount of money paid-out from the storage means; and initializing the value of the amount of money stored and held in the memory means when the detected output at the time the power is turned on, is different from the detected output stored and held in the memory means.

8. The money processing method according to claim 7, further comprising:

storing coin in a coin tube;

detecting, by a switching means disposed at a predetermined position of the coin tube, whether or not a number of coins stored in the coin tube is not more than the predetermined number corresponding to the disposed position of the coin tube; and initializing a value of the number of coins stored and held in the memory means based on the predetermined number.

9. The money processing method according to claim 8, further comprising detecting, by an empty switch which is disposed at a lower part of the coin tube, whether or not the number of coins stored in the coin tube is not more than the predetermined number.

10. The money processing method according to claim 8, further comprising detecting by a full switch which is disposed at an upper part of the coin tube that the coin tube is full with coins.

11. The money processing method according to claim 8, further comprising:

storing and holding type of coin tube and initializing at the time the power is turned on, the value the number of coins stored and held in the memory means if the type of coin tube is different from the type of coin tube stored in the memory means.

12. The money processing method according to claim 8, further comprising:

storing and holding predetermined data initializing at the time the power is turned on, the value of the number of coins stored and held in the memory means if the predetermined data stored in the memory meats is different from previously stored predetermined data.

13. An apparatus for money processing in which inserted money is stored in a coin tube and money is paid-out from the money stored in the coin tube, comprising:

a sensor for detecting whether or not the amount of money stored in the coin tube is not more than a predetermined number;

a counter for counting an amount of money based on the amount of money stored in the coin tube and an amount of money paid-out from the coin tube;

a memory for storing and holding a value of the amount of money counted by the counter and the detected output of the sensor, said memory storing and holding information even if the power is cut off;

wherein the value of the amount of money stored and held in the memory is initialized if the detected output detected by the sensor at the time the power is turned on is different from the detected output of the sensor before the power was turned on; and wherein the counter counts the amount of money stored in the coin tube based on the initialized value of the amount of money.

* * * * *